US005916446A

United States Patent [19]

Britz et al.

[11] Patent Number: 5,916,446

[45] **Date of Patent: *Jun. 29, 1999**

[54] PROCESS AND APPARATUS FOR THE SEPARATION OF SOLID MATTER VIA FLOTATION

[75] Inventors: Herbert Britz, Ravensburg-Weissenau; Alexander Peschl, Ravensburg, both of Germany

[73] Assignee: Sulzer-Escher Wyss GmbH, Ravensburg, Germany

[ * ] Notice: This patent is subject to a terminal disclaimer.

[21] Appl. No.: 08/841,618

[22] Filed: Apr. 30, 1997

Related U.S. Application Data

[63] Continuation of application No. 08/552,205, Nov. 2, 1995, Pat. No. 5,690,812, which is a continuation of application No. 08/295,090, Aug. 24, 1994, abandoned.

[30] Foreign Application Priority Data

Sep. 10, 1993 [DE] Germany ..... 43 30 635

[51] Int. Cl.[6] ..... B03D 1/04; B04C 3/00; B04C 3/06

[52] U.S. Cl. ..... 210/703; 210/788; 210/221.2; 210/512.1; 209/164; 209/170; 209/730; 209/733; 162/4

[58] Field of Search ..... 209/170, 164, 209/725; 162/4; 210/221.2, 788, 512.1, 703

[56] References Cited

U.S. PATENT DOCUMENTS

| | | |
|---|---|---|
| 3,557,956 | 1/1971 | Braun . |
| 4,094,783 | 6/1978 | Jackson . |
| 4,214,982 | 7/1980 | Pfalzer . |
| 4,378,289 | 3/1983 | Hunter . |
| 4,397,741 | 8/1983 | Miller . |
| 4,414,112 | 11/1983 | Simpson . |
| 4,560,474 | 12/1985 | Holik . |
| 4,620,926 | 11/1986 | Linck . |
| 4,816,165 | 3/1989 | Carroll et al. . |
| 4,876,016 | 10/1989 | Young et al. . |
| 4,997,549 | 3/1991 | Atwood . |
| 5,008,014 | 4/1991 | Llyod . |
| 5,028,318 | 7/1991 | Aslin . |
| 5,069,751 | 12/1991 | Chamblee . |
| 5,224,604 | 7/1993 | Duczmal et al. . |
| 5,236,090 | 8/1993 | Britz et al. . |

FOREIGN PATENT DOCUMENTS

| | | |
|---|---|---|
| 2120436 | 10/1994 | Canada . |
| 2541136 | 8/1984 | European Pat. Off. . |
| 0198737 | 10/1986 | European Pat. Off. . |
| 3306600 | 2/1983 | Germany . |
| 117726 | 3/1989 | Japan . |
| 1558493 | 4/1990 | Russian Federation . |
| 85/00760 | 2/1985 | WIPO . |
| 8500760 | 2/1985 | WIPO . |
| 91/15302 | 10/1991 | WIPO . |
| 9115302 | 10/1991 | WIPO . |

OTHER PUBLICATIONS

Miller et al. "Water De–Oiling in an Air–Sparged Hydrocyclone", *Filtration& Separation*, pp. 279, 280, and 282, Jul./Aug. 1983.

*Primary Examiner*—Thomas M. Lithgow
*Attorney, Agent, or Firm*—Greenblum & Bernstein P.L.C.

[57] ABSTRACT

Process and apparatus for the separation of solid matter via flotation. The flotation process for the separation of solid matter from a suspension takes place via the utilization of centrifugal forces wherein the suspension is brought into rotation in a separating zone so that the floated components are particularly effectively routed to and concentrated at the center of the separating space, whereby, when viewed axially, floated components and the remaining portion of the suspension is guided in the same direction and out of the separating zone, with the avoidance of vortexes in the flow stream achieving particularly favorable separation effects. In addition, several apparatuses, for carrying out the process, are also set forth.

25 Claims, 2 Drawing Sheets

PROCESS AND APPARATUS FOR THE SEPARATION OF SOLID MATTER VIA FLOTATION

This application is a continuation of application Ser. No. 08/552,205, filled Nov. 2, 1995, (U.S. Pat. No. 56,908,12) which is a continuation of application Ser. No. 08/295,090, filed Aug. 08, 1994 now abandoned.

CROSS REFERENCE TO RELATED APPLICATIONS

This application claims the priority of German Application No. DE P43 30 635.7, filed Sep. 10, 1993, the disclosure of which is incorporated herein by reference in its entirety.

BACKGROUND OF THE INVENTION

1. Field of the Invention

This invention pertains to a process for the separation of solid matter, from a suspension, via flotation, in a separating space wherein the suspension, during floatation undergoes a rotational movement, with this rotational movement being superimposed by an additional movement, the latter extending substantially in a direction of a rotational axis, and whereby the components undergoing flotation are moved radially inwardly. An apparatus for carrying out the process of the invention is also set forth.

2. Discussion of the Background of the Invention and Material Information

Processes of the above described type are utilized in order to separate at least a portion of the solid matter particles suspended in a suspension. The purpose therefore is either the removal of undesired component parts or the purification of dirty waste water. As is well known, during flotation, a foam or flotation sludge, containing the substances to be removed, is formed.

A typical application for the use of such a process is the treatment of a suspension made up of printed old waste paper, in which the printing color particles are already separated from the fibers so that the latter can be selectively removed via flotation (Deinking-Flotation).

Prior Art German Patent Publication DE-C-3 306 600 and cognate U.S. Pat. No. 4,560,474 disclose a flotation apparatus which already utilizes the acceleration field caused by the rotational movement of the suspension. The flotation foam is removed from the flotation apparatus via an upper outlet tube while the cleaned suspension exits at the bottom. This means a separation of the incoming stream, viewed axially, into oppositely directed partial streams. Such a stream conduction is also normally utilized in hydrocyclones and leads to an overproportional increase in centrifugal acceleration, toward the middle or center of the container, in the form of a so-called potential vortex.

SUMMARY OF THE INVENTION

The object or purpose of this invention is to create a process which, via the use of a centrifugal field, permits an even better or more efficient separation of the suspended solid particles or the use of a relatively compact flotation apparatus or both.

The object or purpose of this invention is achieved via a process for the separation of solid matter from a suspension via flotation in a separating space, the process including: subjecting the suspension, during the flotation, to a rotational movement; superimposing, upon the rotational movement, an additional movement, the additional movement extending substantially in a direction of a rotational axis, whereby the components undergoing flotation are moved radially inwardly; and moving the components undergoing flotation substantially in the direction of the rotational axis which axis is substantially identical with the direction of the additional rotational movement of the suspension.

A further embodiment of the process of this invention further includes producing, in the supplied suspension, in a known manner, micro turbulances in the separating space closely adjacent to an inlet thereof. Preferably, the separating space is substantially cylindrical relative to the vertical rotational axis.

A further embodiment of the process of this invention further includes extending the superimposed movement of the suspension substantially vertically downwardly. Preferably, both the inlets and outlets for the suspension are tangentially located.

An additional embodiment of the process of this invention further includes adding the air, required for flotation, into the separating space together with the suspension. A variation thereof includes adding the air, required for flotation, to the suspension in the separating space.

A yet further embodiment of the process of this invention further includes admixing the air, required for flotation, in the region of the micro turbulence.

A yet another embodiment of the process of this invention further includes including dissolved air in the suspension undergoing flotation and producing the air bubbles required for flotation by a drop in pressure within the suspension.

A yet additional embodiment of the process of this invention further includes removing the flotated components from the separating space in several fractions. A variation thereof includes separating substances, in one of the fractions, in a subsequent process step.

A flotation apparatus, for carrying out the process of this invention, includes: a substantially rotationally symmetric flotation container, the container having at least one tangential inlet for the incoming suspension; means for producing and distributing air bubbles; at least one tangential outlet for the outgoing suspension; at least one sludge collecting tube for collecting the flotated constituents; the tube being located in a central region of the flotation container; wherein the at least one sludge collecting tube, when viewed axially, being arranged at a portion of the flotation container in which portion the outlet tube is located.

In a further embodiment of the flotation apparatus of this invention, the flotation container is in a substantially vertical position during the operation thereof.

In another embodiment of the flotation apparatus of this invention, the inlet is arranged in an upper region of the flotation container and the outlet and the sludge collection tube are arranged in a lower portion of the flotation container.

In an additional embodiment of the flotation apparatus of this invention, the flotation container is a circular cylinder. In a variation thereof the flotation container converges in a direction toward the outlet.

A yet further embodiment of the flotation apparatus of this invention includes a turbulence producer that is located in the region of the inlet. In a variation thereof, the turbulence producer is a nonsequentially increasing stepped diffusor.

In yet another embodiment of the flotation apparatus of this invention, the air required for flotation is supplied to the turbulence producer. In a variation thereof, the air required for flotation is radially introduced into the flotation container through a permeable wall portion thereof.

In yet an additional embodiment of the flotation apparatus of this invention, the air bubbles, required for flotation, are produced by means of a damper, located in one of before and in the inlet, via a pressure drop in the suspension.

In a differing embodiment of the flotation apparatus of this invention, the ratio of the largest inner diameter of the sludge collection tube to the largest inner diameter of the flotation container is larger than 0.60.

In still a further embodiment of the flotation apparatus of this invention, the sludge collection tube includes two concentric substantially axially overlapped tubes, so that several differing fractions of flotated substances can be removed therethrough. Preferably, the apparatus includes two concentric tubes.

In yet a different embodiment of the flotation apparatus of this invention, a tangential outlet is provided in at least one of the regions formed by the concentric tubes. preferably, the tangential outlet is provided in a radially outer one of the regions formed by the concentric tubes.

With the use of the process of this invention, there is no occurrence in the flotation chamber of a rerouting of the transportation direction of the foam. Thereby, the formation of a potential vortex is purposely avoided.

In the region where the flotated substances are accumulated, this permits an undisturbed axial flow of the foam in the direction toward the exit of the foam. Hardly any disturbing vortexes can thus occur in the separation region of the foam and the suspension. This region is particularly critical in regard to the purity of the flotation base material.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

Figure 1:
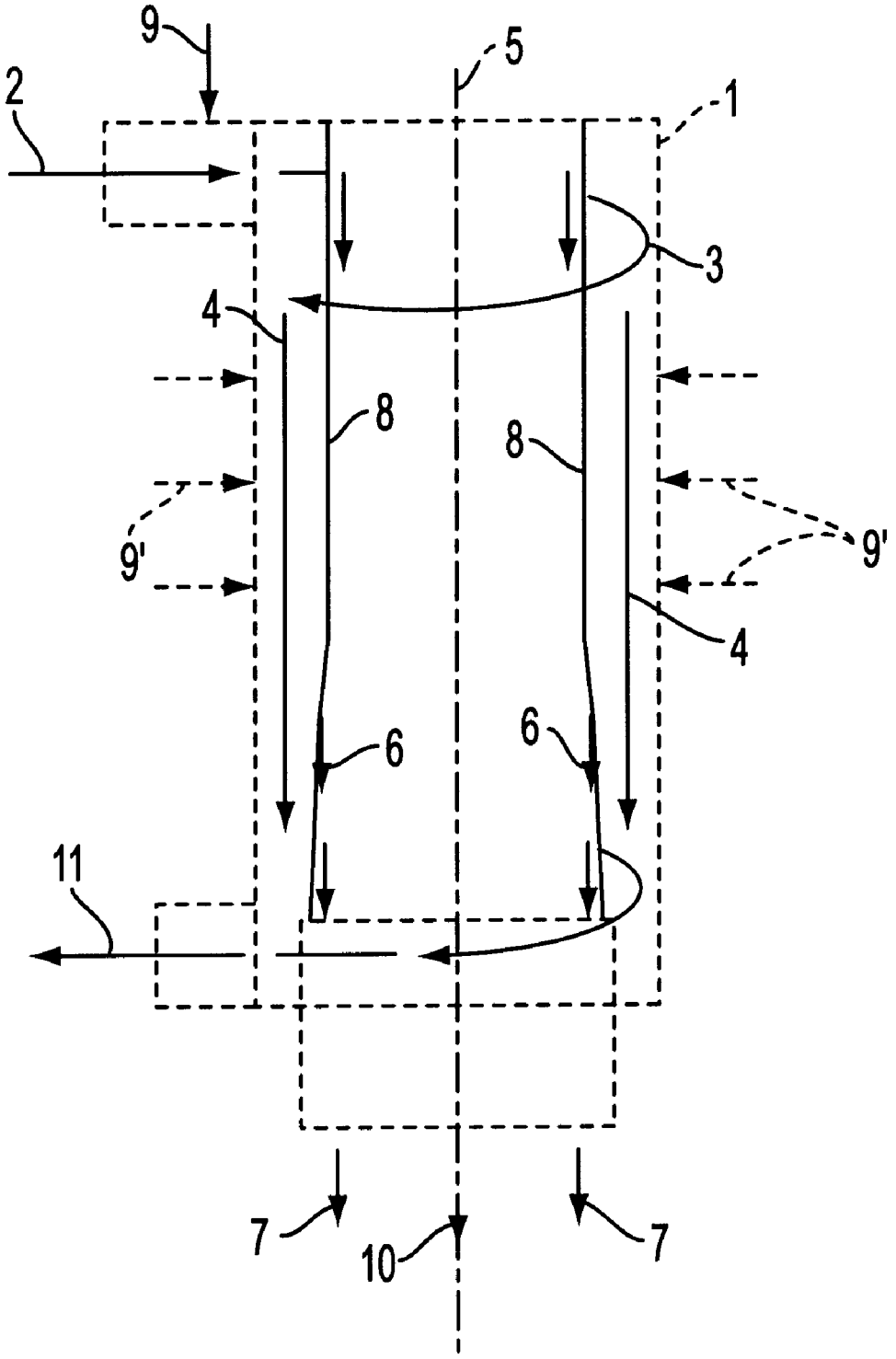
FIG. 1 is a schematic showing of the most important process steps of this invention.

In FIG. 1, a suspension 2 is introduced into a settling area or separating space 1, bounded by broken lines. After its introduction, suspension 2 carries out a rotational movement, as indicated by arrow 3, around rotational axis 5. Overlying or superimposed upon rotational movement 3 is a further movement, indicated by arrows 4, which further movement occurs substantially parallel to rotational axis 5. As a result of the known flotation mechanism the substances undergoing flotation rise, together with air bubbles, against the action of a gravitational field. Since the gravitational field occurs as a centrifugal field, due to rotational movement 3, the portions undergoing flotation move radially inwardly. Thus, there is an assembly of flotation foam at the radially inner region of settling area 1 whereby a more or less sharply defined boundary or border 8 is formed between the flotation foam and the air that is separated therefrom. The process of this invention is carried in a manner so that the transporting of the portions undergoing flotation occurs substantially parallel to rotational axis 5 and in the same direction as the superimposed movement 4 (see arrows 6). The so accumulated portions undergoing flotation are removed from settling area 1, as indicated by arrows 7, generally together with free air which escapes from the suspension foam, as indicated by arrow 10. That portion of the suspension 2 from which the flotation portions or particles have been removed, also exits from settling area 1, as indicated by arrow 11. The air required for flotation is added to the substance either at the inlet, as indicated by arrow 9, and/or via openings in settling area 1 during the actual flotation, as indicated by arrows 9.

Figure 2:
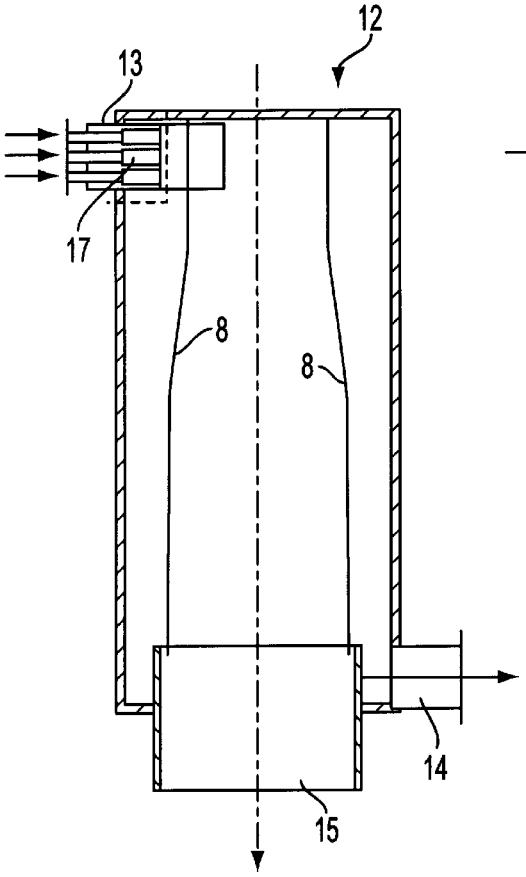
FIG. 2 is a section of a schematic apparatus for carrying out the process of this invention.

FIG. 2 is a simplified section through a flotation container or vessel 12, via which the process of this invention can be carried out. Container 12 includes an inlet 13 and an outlet 14 (here displaced for drawing purposes) as well as a mud or sludge collecting tube 15. Preferably, inlet 13 is provided with an apparatus 17 for producing turbulence, which here takes the form of a stepped diffusor, into which air is pumped or sucked, via an air conduit 16, in the vicinity of the progressive ratio of the diffusor. In order to produce the widest possible flat stream, several stepped diffusers are stacked in the vertical direction, but in the radial direction only one diffuser is utilized. The production of turbulence, via the use of stepped diffusers, at the inlets of flotation apparatuses is known as such, but in combination with the other features of the process of this invention provides particular advantages. It is a part of the objective to obtain, in the smallest possible space, the highest possible flotation effect. Thus controlled micro vortexes and an increased force field, enhanced by rotational movement, are of great benefit. Preferably, the air bubbles required for flotation are produced, by means of a damper (not shown) located before or in the inlet tube 13, via a pressure drop in the suspension. In addition, turbulence producer 17 is a preferably nonsequentially increasing stepped diffuser.

Figure 3:
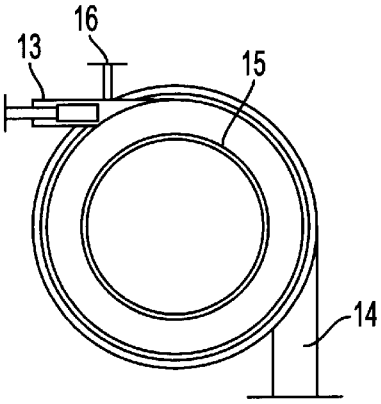
FIG. 3 is a top plan view of the apparatus of FIG. 2.

FIG. 3 is a top plan view of the apparatus of FIG. 2 and particularly shows the tangential inlet 13 and outlet 14.

Figure 4:
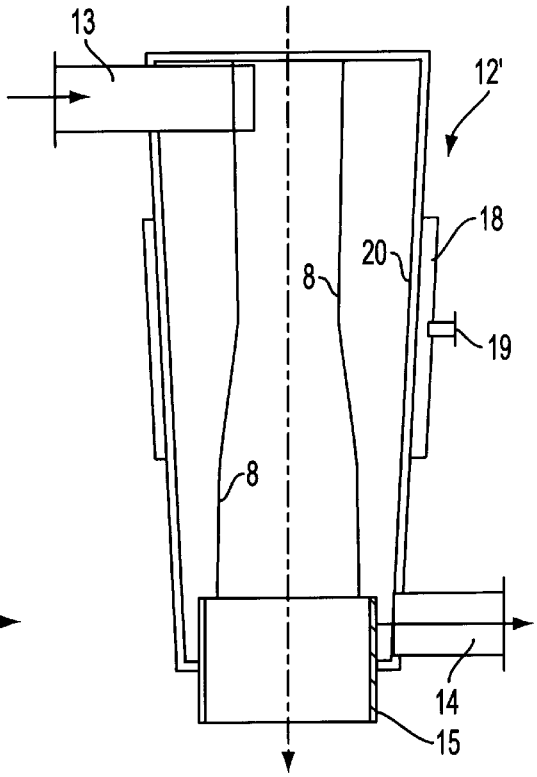
FIG. 4 is an additional apparatus for carrying out the process of this invention.

FIG. 4, in contrast to FIG. 2, does not show a cylindrical flotation container, but rather a slightly conical flotation container 12'. It is known that such a measure accelerates the rotational movement, without requiring additional added energy, thereby approximately compensating for frictional losses. In addition, it is to be expected that, due to effluent air in the center of the flotation container, the total volume of the suspension is decreased. In a further embodiment, not necessarily limited to the conical form of the flotation container, the suspension is aerated, during the flotation, via an air box or reservoir 18which includes an air inlet or connection 19. Of course, in this instance, suitable steps must be undertaken, in the region of wall or partition 20, to provide and entrance for air into the suspension via, for example, a porous or apertured arrangement.

Figure 5:
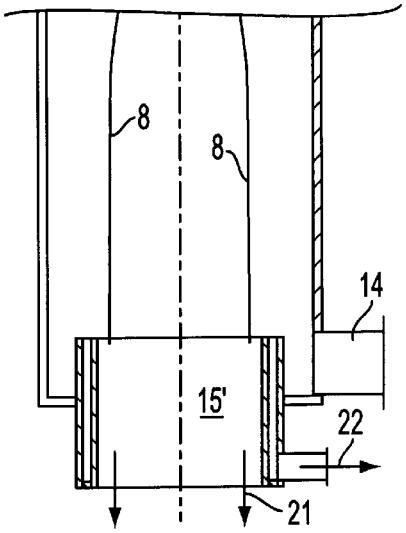
FIG. 5 is a further embodiment of the foam discharge.

FIG. 5 illustrates a further flotation apparatus which is useful for the utilization of the process of this invention, particularly in the area of sludge collecting tube 15'. Tube 15' takes the form of a concentric dual tube so that two differing fractions can be extracted from the central portion of the flotation container. It can be of particular advantage to extract the highest possible foam fraction 21 separately relative to a mixed foam/suspension fraction 22. From fraction 22, via a further separating step, additional useable substances can be obtained, for example, unintentionally removed paper fibers. Preferably, the ratio of the largest inner diameter of the sludge collection tube 15, 15' to the largest inner diameter of the flotation container 12, 12' is larger than 0.60.

The stream or flow control, in the sense that there is an inlet at the upper part of the flotation container and that the foam as well as the cleaned suspension is removed at the lower portion thereof, is not mandatory. A reverse stream or flow control is feasible and, in special cases, even advantageous.

It is entirely feasible to combine a plurality of flotation containers into modules whereby the desired objective of a compact arrangement of the entire flotation layout is achieved more efficiently. Such a modular unit can essentially be comprised of the previously described flotation containers.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A process for separating undesired components from a suspension via flotation in a separating space having a longitudinal axis, an outlet end positioned at a first location on the longitudinal axis, and an inlet end positioned at a second location on the longitudinal axis that is axially displaced from the first location, the process including:

adding air to the suspension to produce air bubbles;

creating micro turbulence in the suspension to mix the air bubbles with the suspension, whereby the micro turbulence created provides energy to join the air bubbles with the undesired components;

feeding the suspension into the separating space through an inlet at the inlet end of the separating space;

rotationally moving the suspension around said longitudinal axis to separate the suspension into separated fractions including a flotation portion and a purified portion;

axially moving the flotation portion with respect to the longitudinal axis of the separating space, the flotation portion including the undesired components to be removed from the suspension;

moving the purified portion, including components remaining after the undesired components have been removed from the suspension, in a same direction with said flotation portion; and removing the flotation portion and the purified portion of the suspension through separate outlets at the outlet end of the separating space.

2. The process according to claim 1, further comprising:

wherein a boundary layer is formed between the flotation portion and air separated from the flotation portion.

3. The process of claim 1, wherein the separating space is substantially cylindrical relative to said longitudinal axis.

4. The process of claim 3, further including: extending the superimposed movement of the suspension substantially parallel to and in a direction of gravity.

5. The process of claim 3, further including: locating the inlet of the suspension tangentially to the separating space.

6. The process of claim 3, further including: locating the outlet for the purified portion tangentially to the separating space.

7. The process of claim 1, further including: adding the air, required for flotation, into the separating space together with the suspension.

8. The process of claim 1 further including: admixing the air, required for flotation, in the region of the micro turbulence.

9. The process of claim 1, further including: adding the air, required for flotation to the suspension in the separating space.

10. The process of claim 1, further including: including dissolved air in the suspension undergoing flotation and mixing the air bubbles with the suspension by a drop in pressure within the suspension.

11. The process of claim 1, further including: removing flotated components of the flotation portion from the separating space in several fractions.

12. The process of claim 11, further including: separating substances, in one of the fractions, in a subsequent process step.

13. An apparatus for separating undesired components from a suspension via flotation in a separating space, comprising:

a substantially rotationally symmetric flotation container having an inlet end located at a first location on the flotation container, and an outlet end located at a second location on the flotation container;

the inlet end and the outlet end being axially displaced from each other;

a suspension inlet located at the inlet end of the flotation container;

a purified component outlet located at the outlet end of the flotation container for passing components of the suspension other than the undesired components;

an air supply device for supplying air to the suspension;

a micro turbulence generator for creating micro turbulence in the suspension; and at least one sludge collecting tube for collecting the undesired components, the at least one sludge collecting tube being located in a central region of the flotation container and at a same end of the flotation container as the outlet end.

14. The flotation apparatus of claim 13, the suspension inlet being arranged in an upper region of the flotation container and the purified component outlet and the sludge collection tube being arranged in a lower portion of the flotation container.

15. The flotation apparatus of claim 13, the flotation container comprising a circular cylinder.

16. The flotation apparatus of claim 13, the flotation container having sides that converge in a direction toward the outlet end.

17. The flotation apparatus of claim 13, the micro turbulence generator being located at the inlet end.

18. The flotation apparatus of claim 17, the micro turbulence generator being a nonsequentially increasing stepped diffusor.

19. The flotation apparatus of claim 17, the air supply device being coupled to the micro turbulence generator so that the created micro turbulence mixes the air and the suspension.

20. The flotation apparatus of claim 13, the flotation container comprising an air permeable wall, and the apparatus further comprising:

a second air supply device that supplies air through the air permeable wall.

21. The flotation apparatus of claim 13, further comprising a damper positioned one of before and in the suspension inlet;

the damper being coupled to the air supply device to produce air bubbles via a pressure drop in the suspension.

22. The flotation apparatus of claim 13, a ratio of a largest inner diameter of the sludge collection tube to a largest inner diameter of the flotation container is greater than 0.60.

23. The flotation apparatus of claim 13, the sludge collection tube comprising two concentrically oriented tubes, so that different fractions of the undesired components may be separately removed from the flotation container.

24. The flotation apparatus of claim 23, at least one of the two concentrically oriented tubes includes a tangentially oriented outlet.

25. The flotation apparatus of claim 23, a radially outwardly positioned one of the at least two concentrically oriented tubes includes a tangentially oriented outlet.

* * * * *